United States Patent [19]

Baysinger

[11] B 3,989,486

[45] Nov. 2, 1976

[54] ELECTROSTATIC AIR CLEANER WITH AIR FLOW RESPONSIVE SWITCH

[75] Inventor: Robert L. Baysinger, St. Louis County, Mo.

[73] Assignee: Emerson Electric Co., St. Louis, Mo.

[22] Filed: July 22, 1974

[21] Appl. No.: 490,806

[44] Published under the second Trial Voluntary Protest Program on February 3, 1976 as document No. B 490,806.

[52] U.S. Cl. ..... 55/105; 55/138; 55/139; 55/270; 55/DIG. 34; 323/22 SC; 340/239 R

[51] Int. Cl.[2] ..... B03C 3/68

[58] Field of Search ..... 55/104, 105, 106, 136, 55/137, 138, 139, 217, 270, 274, DIG. 34; 340/227 R, 228 R, 239 R, 239 F; 137/551, 553, 554; 337/298; 323/22 SC, 68, 69, 70; 338/22 R, 225 D, 23, 24, 25, 53, 57

[56] References Cited

UNITED STATES PATENTS

| | | | |
|---|---|---|---|
| 2,625,239 | 1/1953 | Senne | 55/217 |
| 3,372,328 | 3/1968 | Pinckaers | 323/22 SC |
| 3,395,334 | 7/1968 | Stein | 323/22 SC |
| 3,469,177 | 9/1969 | Lorenz | 323/19 |
| 3,473,101 | 10/1969 | Muskovac | 318/334 |
| 3,475,677 | 10/1969 | Swinehart et al. | 307/310 X |
| 3,486,042 | 12/1969 | Watrous | 308/1 X |
| 3,504,482 | 4/1970 | Goettl | 55/139 |
| 3,609,457 | 9/1971 | Squiers | 317/13 C |
| 3,668,373 | 6/1972 | Laing | 338/25 X |
| 3,697,863 | 10/1972 | Kilner | 338/24 X |
| 3,740,926 | 6/1973 | Duval | 55/104 |
| 3,781,839 | 12/1973 | Bodge | 340/239 R |
| 3,785,124 | 1/1974 | Gaylord | 98/115 K X |
| 3,788,041 | 1/1974 | Gaylord | 55/DIG. 36 |
| 3,794,950 | 2/1974 | Kilner | 219/505 X |

FOREIGN PATENTS OR APPLICATIONS

| | | | |
|---|---|---|---|
| 248,429 | 10/1963 | Australia | 55/105 |

OTHER PUBLICATIONS

"Installation Manual SC-900-C", Electro-Air Division, Emerson Electric Co., Olivia & Sproul Sts., McKees Rocks, Penn. 15136, 10 pages.

*Primary Examiner*—Frank W. Lutter
*Assistant Examiner*—Kathleen J. Prunner
*Attorney, Agent, or Firm*—Charles E. Markham

[57] ABSTRACT

An air flow responsive switching means controlling "on" and "off" operation of an electrostatic air cleaner comprises a controlled solid state switch having gating means including a thermistor arranged to be cooled by air flow. The thermistor is incorporated with the high voltage power supply circuit in a casing for convenient removal and replacement.

2 Claims, 3 Drawing Figures

ELECTROSTATIC AIR CLEANER WITH AIR FLOW RESPONSIVE SWITCH

This invention relates to automatic switching means controlling operation of an electrostatic air cleaner, so that an ionizing voltage is developed only when there is air flow through the cleaner, and, particularly, to solid state switching and air flow sensing means.

The high voltages applied to the ionizing grid and collector plates of electrostatic air cleaners result in the conversion of some oxygen ambient to these cleaner elements to its allotropic form, ozone. When there is continuous sufficient air flow through the air cleaner, dilution of this ozone is such that it is usually not detected or at least it is not objectionable. However, when these high voltages are applied for considerable periods of time during which little or no air is passing through these cleaner elements, an accumulation of ozone occurs which does result in an objectionable odor when air flow through the air cleaner is subsequently started.

Because electrostatic air cleaners are frequently installed in air ducts of heating and cooling systems through which air is intermittently circulated by a blower operated in accordance with heating or cooling requirements, some means to interrupt the application of high voltages to these air cleaner elements during the blower "off" periods is desirable.

Accordingly, it is an object of this invention to provide an electrostatic air cleaner having incorporated therein generally new and improved automatic switching means operative to effect the generation of ionizing voltages only when there is sufficient air flow through the ionizing grid and collector cells.

A further object is to provide an electrostatic air cleaner wherein the high voltage generating circuit is enclosed in a casing arranged for convenient detachable connection mechanically and electrically with an ionizing and collector unit and wherein air flow responsive switching means, including an air flow sensing element, is mounted in the detachable casing with the voltage generating circuit.

A further object is to provide an electrostatic air cleaner having ionizing grid means and collector cell means mounted directly in a path of forced air flow and air flow responsive switching means controlling operation of the air cleaner including an air flow sensing element mounted adjacent the forced air flow path and responsive to air flow induced by velocity pressure drop in the forced air flow path.

A further object is to provide an electrostatic air cleaner having air flow responsive switching means controlling the operation thereof comprising controlled solid state switching means and gating circuit means therefor, including a temperature variable resistor which is constantly heated by flow of electrical current therethrough to a temperature at which it is operative to cut off conduction of said switching means and which is cooled by air flow, when it occurs, to a temperature at which it is operative to effect conduction through said switching means.

Other objects and advantages will appear from the following description when read in connection with the accompanying drawings.

Figure 1:
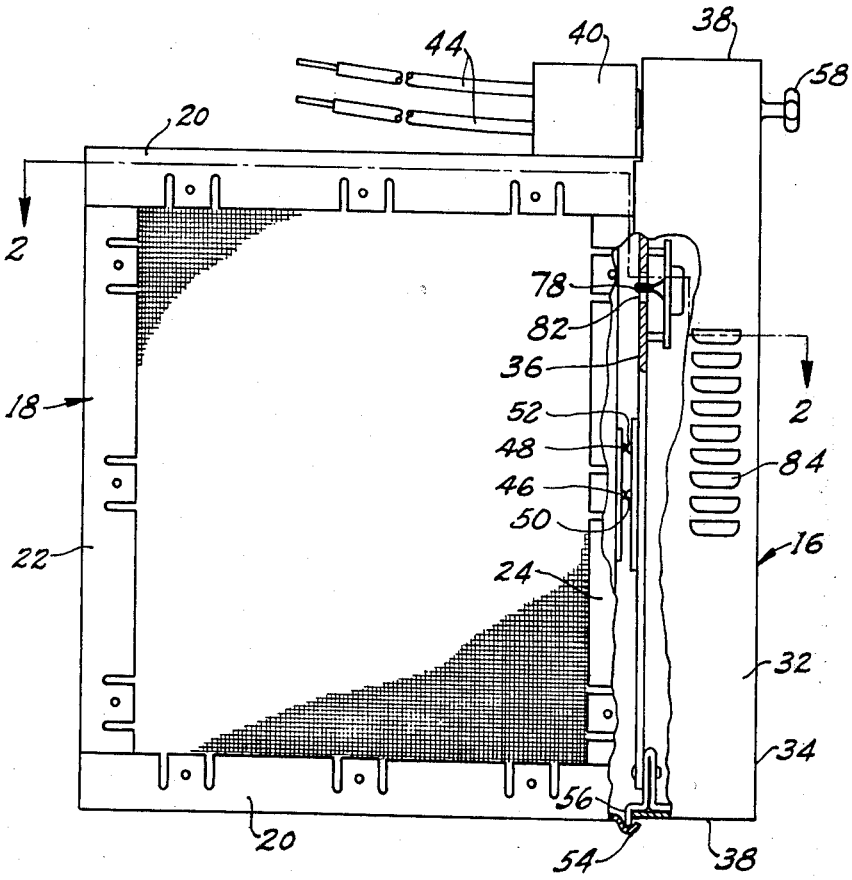
FIG. 1 is a side elevational view of an electrostatic air cleaner constructed in accordance with the present invention.
Figure 2:
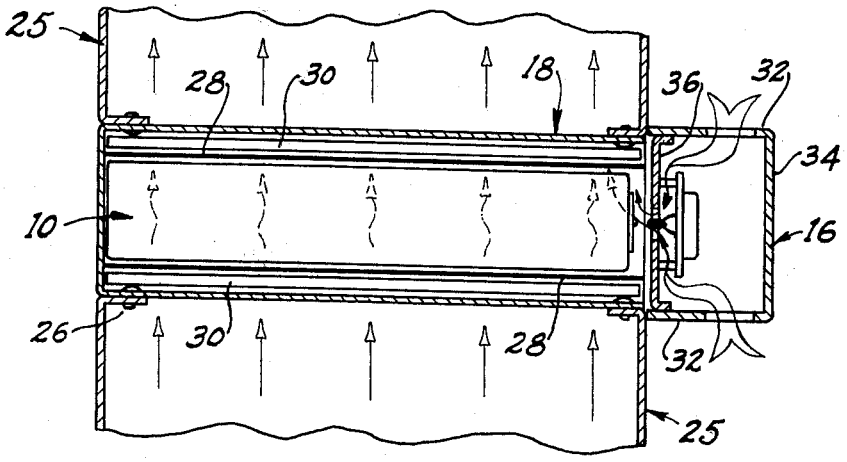
FIG. 2 is a cross-sectional view of the air cleaner of FIG. 1, taken along line 2—2 of FIG. 1, shown mounted in an air duct.
Figure 3:
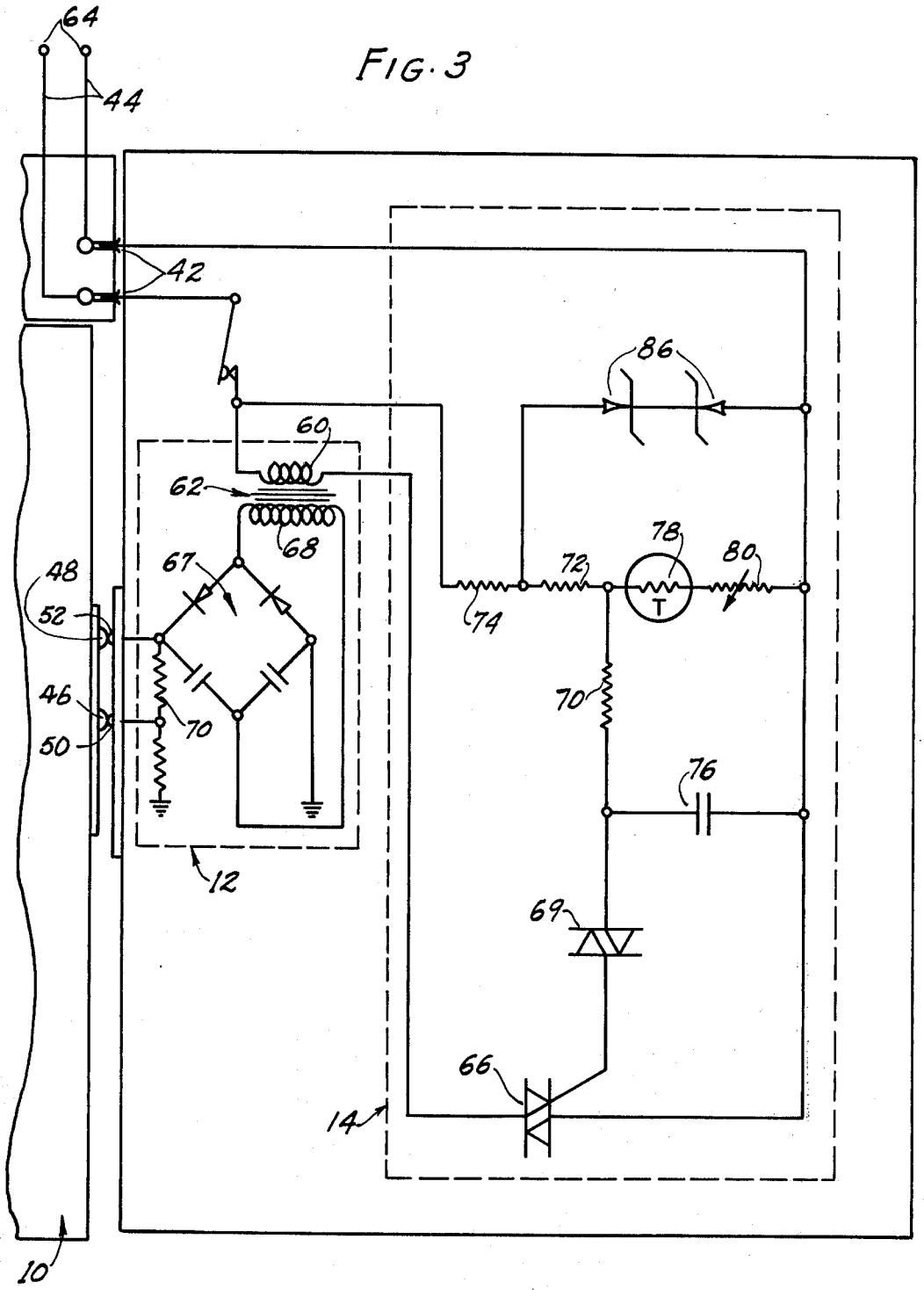
FIG. 3 is a diagrammatic illustration of the high voltage generating circuit and air flow responsive switching means.

Referring to the drawings in more detail, the electrostatic air cleaner shown in FIG. 1 and FIG. 2 comprises an ionizing and collector unit generally indicated at 10, in FIG. 2, and a power unit comprising a high voltage generating circuit 12 and air flow responsive switching means 14, see FIG. 3, housed in a casing 16. The ionizing and collector unit 10 conventionally consists of an ionizing grid and collector plates and is slidably entered into an open end frame generally indicated at 18.

The frame 18 comprises upper and lower horizontal channel-shaped members 20, a rear vertical channel member 22, and front vertical plates 24 attached to the legs of the horizontal members 20. Frame 18 is positioned transversely in an air duct 25 and is connected therein by rivets 26. The lower horizontal channel member 20 is provided with two spaced, parallel, vertical extrusions 28 extending the length thereof which provide a guide track for the ionizing and collector unit 10. There are also two mechanical air filters 30 slidably entered into frame 18, one on each side of the ionizing and collector unit 10.

The elongated casing 16, which houses the high voltage generating circuit 12 and air flow responsive switching means 14, diagrammatically indicated in FIG. 3, is of rectangular cross-sectional configuration comprising side walls 32, a front wall 34, a rear wall 36, and end walls 38. There is a power source terminal block 40 fixed on the upper frame member 20 having push-fit terminals 42, see FIG. 3, for connection of the switching and voltage generating circuits with power supply leads 44. There are also contact elements 46 and 48 on the front side of ionizing and collector unit 10 and cooperating contact elements 50 and 52 on the rear wall 36 of power unit casing 16 which engage to provide electrical connections between the high voltage generating circuit 12 and the ionizing and collector unit when the power unit casing 16 is connected to frame 18.

Power unit casing 16 is detachably connected to frame 18 by interlocking lip portions 54 and 56 on the lower horizontal frame member 20 and on the lower end wall 38 of casing 16 by a conventional rotating latch element cooperating with keeper means on the terminal block 40 operated by a handle 58.

Referring to FIG. 3 of the drawings, the primary winding 60 of a voltage step-up transformer 62 is connected across power supply terminals 64 of an alternating current power supply through triac 66. When triac 66 is conducting, a stepped-up voltage is alternately applied across a voltage doubler network 67 by a secondary winding 68 of transformer 62. The output voltage of the voltage doubler network is applied to the ionizing grid through contacts 48 and 52 and a somewhat lower voltage is applied to the positively charged collector plates through a resistor 70 and contacts 46 and 50, the negative collector plates being suitably grounded.

A gating network for triac 66 comprises a triggering diac 69 connected between one side of triac 66 and its control electrode through resistors 70, 72, and 74 and connected between the other side of triac 66 and its control electrode through a capacitor 76. In this arrangement per se, the diac 69 will fire and cause conduction of triac 66 each half cycle of the power supply when capacitor 76 becomes charged through the resistors to the threshold voltage of diac 69. However, there is a thermistor 78 with a calibrating resistor 80 connected across the triac 66 in series with resistors 74 and 72 and in parallel with capacitor 76, which thermistor is heated by current passing therethrough and operates to effectively shunt the charging of capacitor 76 to the threshold voltage of diac 69 unless the thermistor 78 is cooled by air flow so as to increase its resistance sufficiently to permit capacitor 76 to change to the threshold voltage of diac 69.

Referring to FIGS. 1 and 2, thermistor 78 is mounted on the rear wall 36 of the power unit casing 16 and extends into an aperture 82 in the rear wall 36, which aperture provides communication between the interior of casing 16 and the air duct 25. The side walls 32 of casing 16 are provided with louvres 84, so that when air is flowing through duct 25, sufficient air flow through louvres 84 and through aperture 82 is induced by the velocity pressure drop in duct 25 to cool thermistor 78 and increase its resistance to a value wherein it is ineffective to shunt the application of a breakdown voltage to diac 69. Under these conditions, when air is being circulated through the duct 25, triac 66 will conduct, and the application of the required voltages to the ionizing grid and collector plates will occur.

When air flow through the duct 25 ceases, as when the circulating blower is shut off, the electrical current passing through thermistor 78 will now heat it and lower its resistance to a value wherein it effectively shunts the application of a firing voltage to diac 69. A pair of Zener diodes 86, connected across the power source terminals 64 in series with resistor 74, regulate the voltage applied across the gating network at a value substantially below the nominal power supply voltage.

When the parameters are such that the gate current of triac 66, when conducting, would otherwise shunt the current flow through thermistor 78 to the extent that it would be insufficiently heated, the provision of resistor 70 insures a sufficient current flow through the thermistor. It will be appreciated that when the cooling air flow ceases, as when the circulating blower is shut off, the thermistor 78 must be heated sufficiently by current flow therethrough to lower its resistance to the point wherein it shunts the charging of capacitor 76 and cuts off conduction of triac 66.

While the size or shape of aperture 82 into which thermistor 78 projects is not critical, there is obviously an optimum size and shape which will result in cooling the thermistor at the rate required to effect the desired response time to a change from no air flow to air flow in the duct.

It will be understood that the thermistor 78 may be mounted in an air duct directly in the path of air flow passing through the air cleaner. In arrangements in which the air cleaner is mounted at the end of an air duct, such as shown in the U.S. Pat. to W. H. Goettl, No. 3,504,482, and wherein the ionizing grid and collector plate assembly are arranged for convenient removal for cleaning while the power unit remains in fixed position, the thermistor 78 may be mounted in a fixed position on a bracket extending it into the main air stream.

I claim:

1. In an electrostatic air cleaner, an electrical power source, an air duct, an ionizing and collector unit in said air duct, an opening in the wall of said duct for the entry and removal of said unit, a casing detachably connected to said duct including a wall portion covering said opening in said duct wall, voltage step-up means and air flow responsive switching means housed in said casing, cooperating contact aperture on said unit and on said casing wall portion providing electrical connections between said voltage step-up means and said unit, an aperture in said casing wall portion, said air flow responsive switching means comprising a controlled solid state switch operative when gated to connect said voltage step-up means across said power source, gating circuit means for said switch including a temperature variable resistor connected across said switch, said resistor being heated by electrical current in the absence of cooling air flow to a temperature at which its resistance prevents gating of said switch, said resistor being mounted in said aperature in said casing wall portion and said casing having an opening in a wall thereof remote from said duct opening to permit induced air flow through said aperture when there is air flow through said duct, and said resistor being cooled sufficiently by a predetermined induced air flow through said aperture to render it ineffective to prevent gating of said switch.

2. The electrostatic air cleaner claimed in claim 1 wherein said temperature variable resistor has a negative coefficient of resistance and is arranged in said gating circuit means so as to shunt the gating of said switch in the absence of sufficient cooling air flow through said aperture.

* * * * *